United States Patent [19]

Nomoto et al.

[11] Patent Number: 4,604,868

[45] Date of Patent: Aug. 12, 1986

[54] CLEANER CONTROL FOR DIESEL ENGINE EXHAUST GASES

[75] Inventors: Yoshitaka Nomoto; Tsutomu Matsuoka, both of Higashihiroshima, Japan

[73] Assignee: Mazda Motor Corporation, Hiroshiuma, Japan

[21] Appl. No.: 556,616

[22] Filed: Nov. 30, 1983

[30] Foreign Application Priority Data

Dec. 4, 1982 [JP] Japan ..... 57-184193

[51] Int. Cl.[4] ..... F01N 3/02

[52] U.S. Cl. ..... 60/286; 55/283; 55/DIG. 30; 60/303; 60/311

[58] Field of Search ..... 60/286, 303, 311, 288, 60/738; 55/283, DIG. 30

[56] References Cited

U.S. PATENT DOCUMENTS 1,052,588 2/1913 Janicki ..... 60/738

3,892,071 7/1975 Garcea ..... 60/288

4,450,682 5/1984 Sato ..... 55/283

*Primary Examiner*—Douglas Hart

*Attorney, Agent, or Firm*—Burns, Doane, Swecker and Mathis

[57] ABSTRACT

An exhaust cleaner system for a diesel engine comprising a cleaner having a filter and also having upstream and downstream compartments on respective sides of the filter, carbon particulates in the exhaust gases from the engine being trapped in the filter as the exhaust gases flow through the cleaner, a burner for producing a high temperature combustion gas necessary to elevate the temperature of the exhaust gases, an air supply device for supplying air to the burner, a fuel supply device for supplying fuel to the burner, and an air pressure regulator for increasing the air supply pressure in correspondence with the increase of the exhaust gas pressure upstream of the filter.

3 Claims, 1 Drawing Figure

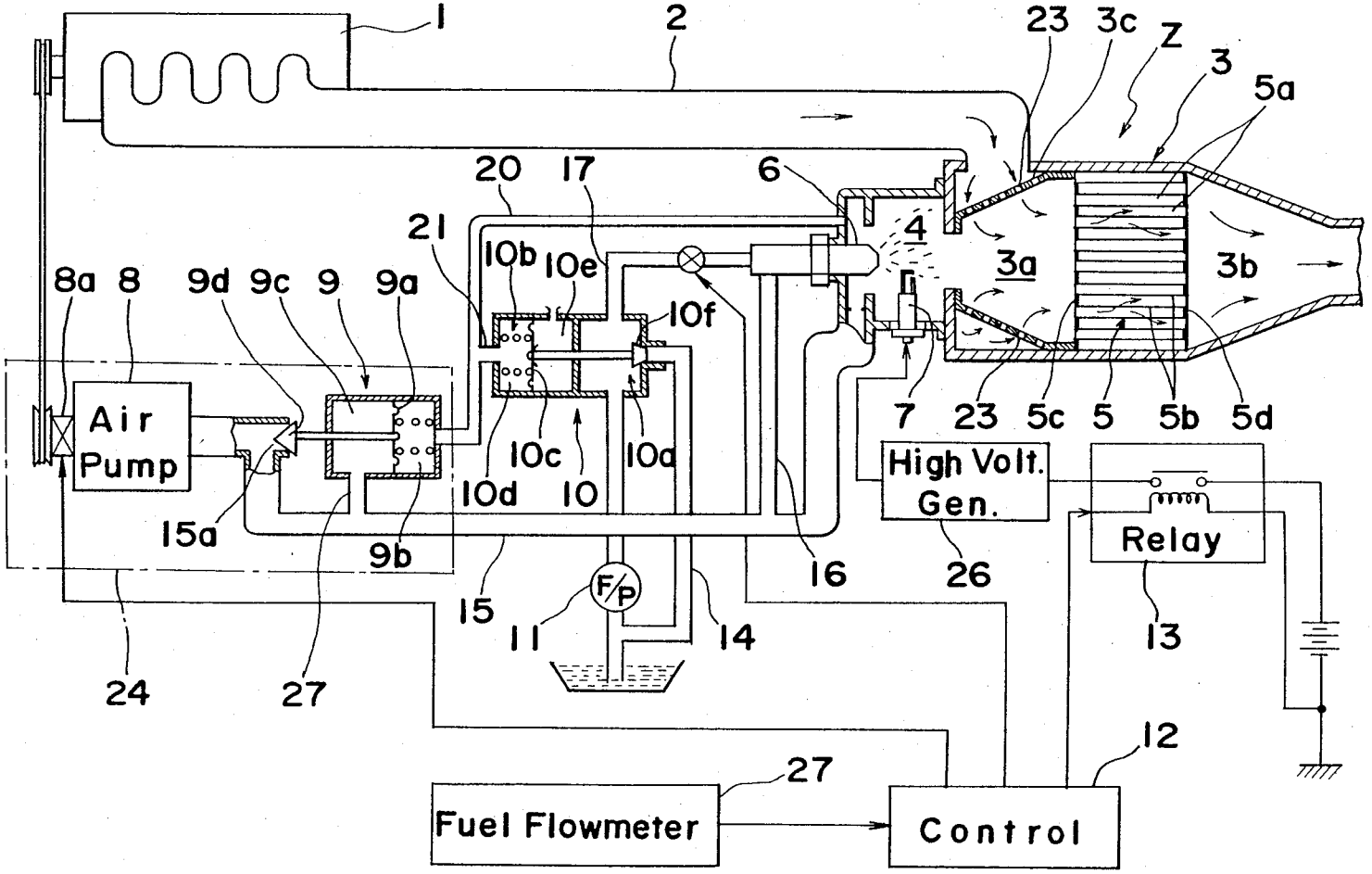
Relay
High Volt. Gen.
Control
Fuel Flowmeter
Air Pump
F/P
1
2
3
3a
3b
3c
4
5
5a
5b
5c
5d
6
7
8
8a
9
9a
9b
9c
9d
10
10a
10b
10c
10d
10e
10f
11
12
13
14
15
15a
16
17
20
21
23
24
26
27
Z

CLEANER CONTROL FOR DIESEL ENGINE EXHAUST GASES

BACKGROUND OF THE INVENTION

The present invention generally relates to an exhaust gas cleaner for a diesel engine and, more particularly, to a control system for the cyclic rejuvenation of the exhaust gas cleaner.

In a diesel engine power plant, it is well known to use an exhaust gas cleaner for minimizing the emission of obnoxious particulates, particularly carbon particulates, carried in the exhaust gases emerging from the diesel engine. Earlier works were to construct the exhaust gas cleaner mainly with a filter having a multiplicity of tortuous flow passages defined therein for trapping and collecting carbon particulates carried by the exhaust gases. With this type of cleaner, it has been found that, although the carbon particulates collected by the filter can be effectively incinerated during the high load engine operating condition at which the temperature of the exhaust gases emitted is sufficiently high enough to allow them to be combusted, they tend accumulate in the filter to such an extent as to result in the clogging of the flow passages in the filter during the other engine operating condition than the high load operating condition, that is, during the medium or low load engine operating condition at which the exhaust gas temperature is relatively low. When the clogging of the flow passages with the carbon particulates takes place in the filter, the back-pressure increases, resulting in the undesirable operating characteristic of the engine. This has to be avoided in view of the fact that the engine is more frequently operated under the medium or low load condition than under the high load condition.

Accordingly, a sophisticated exhaust gas cleaner available today comprises, in addition to the filter, a burner adapted to be regularly and at periodic intervals operated to heat the exhaust gases to a temperature high enough to allow the carbon particulates trapped in the filter to be combusted. Examples of cleaners of the type described above are disclosed, for example, in Japanese Laid-open Patent Publication No. 49-71315, published July 10, 1974; U.S. Pat. Nos. 4,167,852 and 4,335,574, patented Sept. 18, 1979 and June 22, 1982, respectively; Japanese Patent Publication No. 57-38765, published Aug. 17, 1982; and U.S. Pat. Nos. 4,345,431 and 4,372,111, patented Aug. 24, 1982 and Feb. 8, 1983, respectively.

In any of these prior art cleaner systems, a combustion aiding air is supplied under predetermined pressure to the burner regardless of the pressure dominant inside a burner chamber and, accordingly, the flow of the combustion aiding air is susceptible to change with change in pressure inside the burner chamber which would occur in accordance with the operating conditions of the diesel engine. Once this happens, the air-fuel mixing ratio of a combustible mixture to be combusted within the burner chamber deviates, resulting not only in the insufficient production of heat energies with the carbon particulates consequently incinerated ineffectively, but in the incomplete combustion with a large amount of carbon components consequently discharged to the atmosphere.

SUMMARY OF THE INVENTION

The present invention has been devised with a view to eliminate the above described disadvantages and inconveniences inherent in the prior art exhaust gas cleaner systems for the diesel engine and has for its essential object to provide an improved control system for the diesel engine exhaust cleaner which is effective to cyclically rejuvenate the cleaner by incinerating the trapped carbon particulates with a combustion product of a generally constant heat value available regardless of the variation in pressure inside the burner chamber.

Another object of the present invention is to provide an improved control system of the type referred to above, which may be utilized in association with any existing filter-type cleaner without requiring a drastic remodeling of the cleaner and, therefore, without unreasonably increasing the manufacturing cost of the system as a whole.

According to the present invention, these objects can be accomplished by providing the exhaust gas cleaner system with an air pressure regulating device for regulating the pressure, at which the combustion aiding air is supplied towards the burner, in dependence on the pressure of the exhaust gases present upstream of the filter with respect to the direction of flow of the exhaust gases towards the atmosphere. Specifically, the air pressure regulating device according to the present invention is so designed as to increase the pressure of the combustion aiding air being supplied towards the burner in the event of the increased pressure of the exhaust gases present upstream of the filter and, hence, the burner chamber. This is because the amount of the combustion aiding air supplied to the burner may become short of the requirement in the event that the pressure in the burner chamber has increased to a value in excess of the pressure at which the combustion aiding air is being supplied.

BRIEF DESCRIPTION OF THE DRAWING

These and other objects and features of the present invention will become clear from the following description taken in connection with a preferred embodiment thereof with reference to the only accompanying drawing which illustrates, in a schematic diagram, a diesel engine exhaust system embodying the present invention.

DETAILED DESCRIPTION OF THE EMBODIMENT

Referring now to the accompanying drawing, there is shown a diesel engine exhaust system including a diesel engine 1 of any known construction having an exhaust duct 2 in communication therewith through a known exhaust manifold. An exhaust gas cleaner Z is installed on the exhaust duct 2 for trapping and collecting particulates, essentially carbon particulates carried by the exhaust gases emerging from the engine 1, before they are discharged to the atmosphere. The cleaner Z so far shown generally comprises a generally cylindrical housing 3 having a filter 5 housed and non-movably supported within said housing 3. The filter 5 is preferably of a construction made of a porous ceramic material and having a plurality of closely adjacently juxtaposed, axially extending tortuous flow passages 5*a* separated from one another by open-celled partition walls 5*b*, some of the flow passages 5*a* being closed at an upstream end by a respective blind plug 5*c* and the rest of them being closed at a downstream end by a respective blind plug 5*d*. This filter 5 is so designed and so positioned that the exhaust gases entering the upstream ends of the flow passages 5*a* of which downstream ends are closed by the plugs 5*d* can emerge from the downstream ends of the flow passages 5*a* of which upstream ends are closed by the plugs 5*c* after having traversed the open-celled partition walls 5*b*. The interior of the housing 3 is divided by the filter 5 into upstream and downstream compartments 3*a* and 3*b*, it being to be noted that the terms "upstream" and "downstream" herein used are relative to the direction of flow of a fluid medium. The upstream compartment 3*a* is communicated to the exhaust duct 2 through a multiplicity of perforations 23 in a gas distributing panel 3*c*, and the downstream compartment 3*b* is communicated to the atmosphere.

In the construction so far described, it will readily be seen that the exhaust gases emitted from the engine 1 and subsequently fed to the cleaner Z through the exhaust duct 2 can flow into the upstream compartment 3*a* through the perforations 23 in the gas distributing panel 3*c* and then into the downstream compartment 3*b* through the tortuous flow passages 5*a*, finally being discharged to the atmosphere, in a manner shown by the arrow-headed lines. It will also be seen that, during the flow of the exhaust gases from the upstream compartment 3*a* to the downstream compartment 3*b* across the filter 5, carbon particulates carried by the exhaust gases can be trapped in and, therefore, accumulate on the filter 5.

The housing 3 also has a burner chamber 4 defined therein in communication with the upstream compartment 3*a* and positioned on one side of the compartment 3*a* opposite to the filter 5. The housing 3 supports an injection nozzle assembly 6 and an ignition plug 7 both rigidly mounted thereto so as to confront the burner chamber 4, the respective tips of said nozzle assembly 6 and said plug 7 being so spaced a predetermined distance within the burner chamber 4 that the spark generated by the plug 7 can ignite fuel being atomized from the nozzle assembly 6. In the practice of the present invention, the nozzle assembly 6 and the ignition plug 7 together constitute a burner for producing a combustion product, i.e., a flame, of high temperature enough to elevate the temperature of the exhaust gases, when it intermixes therewith, to a value required to combust the carbon particulates accumulating on the filter 5 as will be discussed later.

The burner chamber 4 is fed with a combustion aiding air from an engine-driven air pump 8 by way of an air supply passage 15 having its opposite ends fluid-connected respectively to the chamber 4 and the air pump 8. A portion of the air flowing towards the chamber 4 through the air supply passage 15 is also fed as an atomizing air to the nozzle assembly 6 through a branch passage 16 branching off from the air supply passage 15, the atomizing air being used to atomize fuel fed to the nozzle assembly 6 through a fuel supply passage 17. The air pump 8 so far shown is of a type adapted to be driven by the engine 1 only when an electromagnetic clutch 8*a* disposed on the drive transmission system between the engine 1 and the air pump 8 is electrically energized to assume a coupling position.

In accordance with the present invention, for controlling the fluid pressure of the air flowing through the air supply passage 15 in dependence on the pressure inside the upstream compartment 3*a* and, hence, that inside the burner chamber 4 in such a way as to maintain the former at a value higher than the latter by a predetermined quantity, an air pressure regulator is employed. This air pressure regulator comprises an air control diaphragm valve assembly 9 and a pressure sensing passage 20. The diaphragm valve assembly 9 comprises a casing having its interior divided by a diaphragm member 9*a* into first and second working chambers 9*b* and 9*c* communicated to the pressure sensing passage 20 and to the air supply passage 15 through a connecting passage 27, respectively, and a valve member 9*d* connected to and displaceable together with the diaphragm member 9*a*. The pressure sensing passage 20 having one end in communication with the first working chamber 9*b* of the valve assembly 9 has the other end communicated to the burner chamber 4 for the introduction of the pressure inside the burner chamber 4 into the first working chamber 9*b*. The valve member 9*d* shown as operable to adjust the opening of a purge hole 15*a* defined in the air supply passage 15 at a location upstream of the connecting passage 27 serves to purge a portion of the air, flowing through the air supply passage 15, to the atmosphere through a controlled clearance between it and the peripheral lip region of the purge hole 15*a* in a varying quantity dependent on the pressure introduced into the first working chamber 9*a*. In other words, the valve assembly 9 is so designed that, when the pressure inside the burner chamber 4 increases to a value higher than the pressure inside the second working chamber 9*c* and, hence, the fluid pressure of the air flowing through the air supply passage 15 during the operation of the air pump 8, the diaphragm member 9*a* and, hence, the valve member 9*d* can be displaced leftwards as viewed in the drawing to reduce the rate of the air being purged to the atmosphere while allowing the fluid pressure of the air in the passage 15 to increase to a value higher than the prevailing pressure inside the burner chamber by the predetermined quantity.

Thus, it will readily be seen that, since the pressure inside the burner chamber and that under which the air is supplied through the air supply passage 15 during the operation of the air pump are substantially in proportional relationship to each other, the combustion air can be supplied into the burner chamber 4 in a constant amount regardless of the change in pressure inside the burner chamber 4. It is to be noted that the engine-driven air pump 8 and the valve assembly 9 together constitute an air supply device 24.

The change in pressure inside the burner chamber 4 adversely affects not only the quantity of the combustion aiding air being supplied into the burner chamber 4, but also the quantity of the fuel being supplied to the nozzle assembly 6. Because the fuel is generally supplied to the nozzle assembly 6 under a higher pressure than that of the combustion aiding air, the extent to which the quantity of the fuel being supplied is adversely affected by the change in pressure inside the burner chamber 4 may be smaller than that to which the quantity of the combustion aiding air being supplied is adversely affected thereby. However, in order for the combustion product of stabilized heat value to be produced within the burner chamber 4 upon the ignition of the atomized air-fuel mixture, an adjustment similar to that effected to the pressure of the air flowing through the air supply passage 15 in the manner as hereinabove described is desirable to be effected also to the pressure of the fuel being supplied towards the nozzle assembly 6 through the fuel supply passage 17.

For this purpose, a fuel pressure regulator for controlling the pressure of the fuel, supplied from a fuel reservoir towards the nozzle assembly 6 by way of a fuel pump 11, in dependence on the pressure inside the burner chamber 4 is employed. The fuel pressure regulator so far shown comprises a fuel control diaphragm valve assembly 10 comprising a casing, the interior of which is divided by a partition wall into a fuel compartment 10*a* and a pressure compartment 10*b*. The fuel compartment 10*a* is communicated on the one hand to a downstream portion of the fuel supply passage 17 between it and the nozzle assembly 6 and on the other hand to an upstream portion of the fuel supply passage between it and the fuel pump 11. The fuel compartment 10*a* is also communicated to the fuel reservoir through a return passage 14 for returning a portion of the fuel, flowing across the fuel compartment 10*a*, back to the reservoir in a manner as will subsequently be described.

The pressure compartment 10*b* of the valve assembly 10 is divided by a diaphragm member 10*c* into first and second chambers 10*d* and 10*e*, the first chamber 10*d* being communicated to the pressure sensing passage 20 through a connecting passage 21 and the second chamber communicated to the atmosphere. The valve assembly 10 also comprises a valve member 10*f* situated within the fuel compartment 10*a* and displaceable together with the diaphragm member 10*c*. The valve member 10*f* so far shown is adapted to adjust the opening of the return passage 14 confronting the fuel compartment 10*a* in dependence on the pressure introduced into the first chamber 10*d*. The valve assembly 10 of the construction so far described is so designed and so arranged that, as the pressure introduced into the first chamber 10*d* and, hence, that inside the burner chamber 4 increases, the pressure of the fuel being supplied towards the nozzle assembly 6 can be correspondingly increased by minimizing or interrupting the return of a portion of the fuel back to the fuel reservoir through the return passage 14. It is to be noted that the valve assembly 10 and the fuel pump 11 together constitute a fuel supply device.

Hereinafter, the operation of the cleaner system according to the present invention will be described.

Assuming that the carbon particulates carried by the exhaust gases emitted from the engine 1 and subsequently flowing through the cleaner Z have been trapped in the filter 5 in the manner as hereinbefore described, the trapped carbon particulates can be substantially satisfactorily and effectively incinerated by the heat evolved by the exhaust gases when and so long as the engine 1 is operated under the high load operating condition. However, when and so long as the engine is operated under either one of the medium and low load operating conditions, the temperature of the exhaust gases as a whole is low, say, lower than that required to combust the carbon particulates, and therefore the carbon particulate in the exhaust gases are permitted to accumulate on the filter 5.

Should the accumulated carbon particulates amount to such an extent as to result in the clogging of the tortuous flow passages 5*a* in the filter 5, the resistance to the flow of the exhaust gases through the filter 5 increases and the operating characteristics of the engine are adversely affected. Under these circumstances, the burner should be operated to produce a high temperature flame within the burner chamber 4 to elevate the temperature of the exhaust gases to a value required to incinerate the accumulated carbon particulates for the rejuvenation of the cleaner Z as a whole.

In the event that the necessity of the incineration of the accumulated carbon particulates on the filter 5 arises, a control unit 12 causes an electric current to flow through a relay coil of the relay 13 to close a relay switch, through the electromagnetic clutch 8*a* to connect the air pump 8 to the engine 1, and through the fuel pump 11 to operate the latter. As the relay switch of the relay 13 is closed, a high voltage generator 26 generates a high voltage with which the ignition plug 7 produces a spark necessary to ignite the air-fuel mixture atomized from the nozzle assembly 6 into the burner chamber 4. The combustion of the air-fuel mixture within the burner chamber 4 results in the flame directed towards the upstream compartment 3*a* and, therefore, the exhaust gases within the upstream compartment 3*a* are heated in contact with the flame to a temperature required to combust the carbon particulates. In this way, the cleaner Z can be rejuvenated.

For operating the burner comprised of the nozzle assembly 6 and the ignition plug 7, numerous methods can be contemplated. By way of example, the burner may be operated cyclically each time the engine has been operated for a predetermined length of time, or each time a predetermined amount of fuel has been consumed by the engine. Alternative methods would be to detect the pressure difference developed between the upstream and downstream compartment, or to detect the change in electric resistances with increase of the amount of the accumulated carbon particulates, so that the burner can be operated when the pressure difference or the electric resistance is found to be of a value higher than a predetermined value. Other than those methods, the burner may be operated at all times during the operation of the engine. However, in the illustrated embodiment, the burner is operated cyclically each time the predetermined amount of fuel has been consumed by the engine 1 and, for this purpose, a fuel flowmeter 27 is utilized to detect the fuel consumption and to generate an output signal to the control unit 12 when and after the fuel consumption so detected has exceeded the predetermined value.

In the event that the pressure inside the upstream compartment 3*a* and, hence, the burner chamber 4 changes according to a particular operating characteristic of the engine 1, the supply of the air into the burner chamber 4 and also to the nozzle assembly 6 are adversely affected. By way of example, where the air is supplied under a predetermined pressure at all times regardless of the change in pressure inside the burner chamber such as in the prior art systems, the amount of the air being supplied decreases with increase of the pressure inside the burner chamber. In the illustrated embodiment, because of the provision of the air control valve assembly 9, the pressure of the air being supplied through the air supply passage 15 can be increased and decreased with increase and decrease of the pressure inside the burner chamber 4, respectively, and therefore, the air can be supplied into the burner chamber 4 in a constant amount regardless of the change in pressure inside the burner chamber 4. By the reason stated above, where the amount of fuel to be supplied is, for example, adjusted to a predetermined value, the fuel and the air can be mixed in a predetermined mixing ratio at all times and, therefore, the burner can produce the combustion product of constant heat value. This in turn results in the efficient and effective incineration of the carbon particulates.

Although the present invention has fully been described in connection with the preferred embodiment with reference to the accompanying drawing, it is to be noted that various changes and modifications are apparent to those skilled in the art. By way of example, the air pressure regulator, which has been described as constituted by the diaphragm valve assembly 9, may comprise an electromagnetic valve assembly which makes use of a pressure sensor, in place of the pressure sensing passage 20, for detecting, and generating a signal indicative of, the pressure inside the burner chamber 4. This equally applies to the fuel pressure regulator which has been described as constituted by the diaphragm valve assembly 10.

Moreover, in the illustrated embodiment, the pressure of the air being supplied has been described as adjusted to a value higher than the pressure of the exhaust gases by the predetermined quantity for the purpose of compensating for variation in pressure of the air resulting from the change in pressure of the exhaust gases. However, it is also possible to control the temperature of the gases entering the filter to a predetermined temperature by increasing the rate of increase of both the air supply pressure and the fuel supply pressure in correspondence with the rate of increase of the exhaust gas pressure and then controlling the heat value of the burner in proportion to the amount of the exhaust gases.

Accordingly, such changes and modifications are to be construed as included within the scope of the present invention as defined by the appended claims unless they depart therefrom.

We claim:

1. An exhaust cleaner system for a diesel engine having an exhaust system for the discharge of exhaust gases emitted from the discharge of exhaust gases emitted from the engine, said cleaner system comprising, in combination:

an exhaust duct for conducting engine exhaust gas;

a cleaner having a filter disposed therein and an upstream compartment located upstream of the filter, said upstream compartment communicating with the exhaust duct for directing exhaust gases to the filter which traps carbon particulates carried by the exhaust gases;

a burner unit including a combustion chamber having an outlet communicating with said upstream compartment and including a fuel nozzle and an igniter for combusting a mixture of fuel and air to produce a flame for providing to said outlet a high temperature combustion gas necessary to elevate the temperature of the exhaust gases entering said upstream chamber to a temperature suitable for incinerating carbon particulates trapped by the filter;

an air supply means for supplying air to the combustion chamber upstream of the outlet thereof;

a fuel supply means for supplying fuel to the combustion chamber upstream of the outlet thereof;

sensing means for sensing pressure inside the combustion chamber upstream of the outlet thereof and for generating a signal indicative thereof;

an air pressure regulating means actuated by said signal for increasing the pressure of the air supplied to the combustion chamber in correspondence with an increase in pressure within the combustion chamber; and a fuel pressure regulating means actuated by said signal for increasing the pressure of fuel supplied to the combustion chamber in correspondence with an increase in pressure within the combustion chamber, said burner operative during the discharge of the exhaust gases through the filter.

2. A system as claimed in claim 1, wherein said air pressure regulating means comprises an air relief valve disposed on an air supply passage, said sensing means comprising a conduit communicating said air relief valve with said combustion chamber.

3. A system as claimed in claim 2, wherein said relief valve is provided with a diaphragm actuator and said sensing means is constituted by a pressure sensing passage through which the exhaust gas pressure is introduced into a pressure chamber of the diaphragm actuator.

* * * * *